US006271447B1

(12) United States Patent
Fujiwara et al.

(10) Patent No.: US 6,271,447 B1
(45) Date of Patent: Aug. 7, 2001

(54) VELOCITY CALCULATING SYSTEM FOR MOVING OBJECT WIDELY VARIED IN VELOCITY METHOD FOR CORRECTING VELOCITY AND KEYBOARD MUSICAL INSTRUMENT EQUIPPED WITH THE VELOCITY CALCULATING SYSTEM FOR ACCURATELY DETERMINING LOUDNESS OF SOUNDS

(75) Inventors: Yuji Fujiwara; Yasuhiko Oba; Tomoyuki Ura, all of Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 09/410,378

(22) Filed: Sep. 30, 1999

(30) Foreign Application Priority Data

Oct. 5, 1998 (JP) ..... 10-283111
Jan. 21, 1999 (JP) ..... 11-013467

(51) Int. Cl.[7] ..... G10F 1/02
(52) U.S. Cl. ..... 84/21
(58) Field of Search ..... 84/2, 3, 19–21

(56) References Cited

U.S. PATENT DOCUMENTS 5,612,502 * 3/1997 Ura ..... 81/21 X
5,663,513 * 9/1997 Sugiyama et al. .
5,679,914 * 10/1997 Niitsuma .
5,691,489 * 11/1997 Fujiwara et al. .
5,731,530 * 3/1998 Fujiwara et al. ..... 84/21

FOREIGN PATENT DOCUMENTS 7-271347 * 10/1995 (JP) .

* cited by examiner

*Primary Examiner*—Jeffrey Donels
(74) *Attorney, Agent, or Firm*—Morrison & Foerster

(57) ABSTRACT

An automatic player piano determines the loudness of an acoustic tone to be reproduced in a playback on the basis of a hammer velocity, and the hammer velocity is calculated on the basis of a long distance defined in a shutter plate attached to each of the hammers for a strongly depressed key or a short distance also defined in the shutter plate for a softly depressed key so as to accurately produce the acoustic tone.

19 Claims, 8 Drawing Sheets

VELOCITY CALCULATING SYSTEM FOR MOVING OBJECT WIDELY VARIED IN VELOCITY METHOD FOR CORRECTING VELOCITY AND KEYBOARD MUSICAL INSTRUMENT EQUIPPED WITH THE VELOCITY CALCULATING SYSTEM FOR ACCURATELY DETERMINING LOUDNESS OF SOUNDS

FIELD OF THE INVENTION

This invention relates to a velocity determining technology and, more particularly, to a velocity calculating system for moving object widely varied in velocity, a method for correcting the velocity and a keyboard musical instrument equipped with the velocity calculating system for accurately determining the loudness of sounds.

DESCRIPTION OF THE RELATED ART

While a pianist is playing a piano, he or she selectively depresses the black/white keys and, thereafter, releases them so as to generate acoustic tones. The depressed black/white key actuates the associated damper mechanism and the associated key action mechanism. The depressed black/white key lifts the damper felt, and the damper felt is spaced from the associated set of strings so as to allow the set of strings to vibrate. On the other hand, the key action mechanism drives the associated hammer for rotation, and the hammer felt strikes the set of strings. Then, the strings vibrate so as to generate the acoustic tone. When the pianist releases the depressed black/white key, the black/white key returns toward the rest position. The released black/white key brings the damper felt into contact with the set of strings, again, and damps the vibrations of the set of strings. This results in the extinguishment of the acoustic tone. If the pianist depresses pedals, i.e., a damper pedal, a sustaining pedal and a soft pedal, the pedal mechanisms impart predetermined effects to the acoustic tones. Thus, the acoustic piano repeats the loop having depressing a black/white key, striking against the strings, releasing the black/white key and damping the vibrations during the performance, and the pedals selectively impart the expressions to the acoustic tones.

An automatic player piano is the acoustic piano equipped with a recording system and a playback system. While a pianist is playing the acoustic piano, each of the black/white keys generates the acoustic tone through the above-described loop, and the pedal mechanisms selectively impart the expressions to the acoustic tones. The recording system monitors the black/white keys so as to generate pieces of music data information representative of the performance. The pieces of music data information are stored in a suitable information storage medium. Otherwise, a tone generator and a sound system produce electronic sounds on the basis of the pieces of music data information in a real time fashion. When the pianist instructs the automatic player piano to reproduce the performance, the playback system reads out the pieces of music data information from the information storage medium, and the actuators selectively actuate the black/white keys and the pedals. In order to exactly reproduce the performance, it is important to exactly monitor the key motion and the pedal motion in the recording mode.

The prior art automatic player piano is equipped with key sensors and pedal sensors. The key sensor is the combination of a shutter plate and a photo sensor such as a photo interrupter. The shutter plate is attached to the lower surface of the black/white key, and the photo sensor is mounted on the key bed. The shutter plate is aligned with the gap of the photo sensor, and intersects the optical beam radiated over the gap. When the shutter plate intersects the optical beam, the photo sensor varies the key position signal representative of the current shutter position, i.e., the current key position, and a controller determines the shutter speed and a timing for generating the tone. If the player simply depresses the black/white key from the rest position to the end position, the key motion is fairly corresponding to the hammer motion, and the key velocity at a certain key position is proportional to the hammer velocity at the strike against the strings. For this reason, the controller determines the loudness of the tone on the basis of the key velocity at the certain key position. However, when the pianist gives rise to a special key motion such as, for example, a repetition of a black/white key in a shallow region, the pieces of music data information tend to represent a different loudness and tone generating timings different from those of the acoustic piano. The shallow repetition has a short stroke, and the acoustic piano does not generate a loud tone. On the other hand, when the pianist gives rise to the shallow repetition in the automatic player piano, the automatic player piano gives a large loudness to the electronic sound, because the black/white key is moved at a high speed.

A hammer sensor eliminates the discrepancy from the electronic sounds. FIG. 1 illustrates a typical example of the hammer sensor incorporated in an automatic player piano of the type having an upright piano. The prior art hammer sensor also comprises a shutter plate 1 and a photo sensor 2. The shutter plate 1 is attached to a hammer shank 3 of a hammer assembly 4, and is movable with respect to the key bed (not shown) together with the hammer assembly 4. The shutter plate 1 is generally rectangular configuration, and has a leading edge 1*a*. A window 1*b* is formed in the shutter plate 1, and is spaced from the leading edge 1*a* by a predetermined distance. The hammer assembly 4 has a hammer head 4*a*, and a set of strings 6 (see FIG. 2) is struck by the hammer head 4*a*.

On the other hand, the photo sensor 2 is attached to a bracket 5, and is stationary with respect to the key bed (not shown). A slit 5*a* is formed in the bracket 5, and the photo sensor 2 radiates an optical beam 2*a* across the slit 5*a*. The shutter plate 1 is inserted into the slit 5*a*, and the leading edge 1*a* intersects the optical beam 2*a*.

When the leading edge 1*a* intersects the optical beam 2*a*, the hammer head 4*a* reaches position H2, and is spaced from the associated strings 6 as shown in FIG. 2. The hammer assembly 4 is further rotated, and the hammer head 4*a* reaches position H3. Then, the window 1*b* allows the optical beam 2*a* to pass therethrough. The hammer assembly 4 is further rotated, and the hammer head 4*a* reaches position H4. The shutter plate 1 intersects the optical beam 2*a*, again. The photo sensor 2 abruptly reduces the photo current at position H2, and recovers the photo current from the small quantity to the large quantity at position H3. The photo current is reduced at position H4, again.

The photo sensor supplies a hammer position signal representative of the amount of photo current to a controller (not shown), and the controller determines the timing at the position H4 to be an impact timing Ht of the strings with the hammer head 4*a*, i.e., a timing to generate the sound. As described hereinbefore, the distance between the leading edge 1*a* and the window 1*b* is known. The controller clocks the lapse of time between the position H2 and the position H4, and calculates the hammer velocity Hv. Then, the controller generates a piece of music data information representative of the impact timing Ht, the hammer velocity Hv, the key code assigned to the depressed key and a lapse of time from the initiation of the performance. The piece of music data information is stored in a suitable memory.

Although the prior art hammer sensor is appropriate to the depressed black/white key, a key sensor is still necessary for the released black/white key. The key sensor monitors the black/white key so that the controller determines the timing to damp the sound. The controller generates a piece of music data information representative of the timing to damp the sound, the key code and the lapse of time from the initiation of the performance. The piece of music data information is also stored in the memory.

FIG. 3 illustrates the relation between the shutter position and the hammer position signal. As described hereinbefore, the hammer position signal is changed from a low level L to a high level H at position H2, from the high level H to the low level L at position H3 and from the low level L to the high level H. The distance between the position H2 and the position H4 is known. If the shutter plate is moved at a constant speed, the controller can simply calculate the hammer velocity Hv by dividing the distance by the lapse of time. In the actual automatic player piano, the hammer assembly 4 and, accordingly, the shutter plate 1 are not moved at a constant speed, and the controller merely calculates the mean hammer velocity between the position H2 and the position H4. The loudness of the acoustic tone is proportional to the final hammer velocity at the strike. If the distance between the positions H2 and H4 is relatively short, the difference between the mean hammer velocity and the final hammer velocity is negligible. However, the distance is too long to ignore the difference. For this reason, a problem is encountered in the prior art automatic player piano in that the acoustic tone reproduced in the playback is not equal in loudness to the original acoustic tone.

If the hammer velocity Hv is calculated on the basis of the distance between the position H3 and the position H4, the difference is small, and the loudness of the reproduced acoustic tone is close to that of the original acoustic tone. When the hammer velocity Hv is calculated on the basis of the distance between the position H2 and the position H4, the hammer position signal rises at both of the positions H2 and H4, and the signal rise time equally affects the lapse of time between the position H2 and the position H4. However, if the hammer velocity Hv is calculated on the basis of the distance between the position H3 and the position H4, the hammer position signal falls at the position H3, and rises at the position H4. The signal rise time is usually not equal to the signal decay time, and the difference seriously affects the lapse of time between the position H3 and the position H4. For this reason, it is undesirable to calculate the hammer velocity on the basis of the distance between the position H3 and the position H4. Moreover, when the black/white key is strongly depressed, the hammer velocity Hv calculated on the basis of the distances H3 and H4 is not reliable, because the resolution is too low.

SUMMARY OF THE INVENTION

It is therefore an important object of the present invention to provide a velocity calculating system, which exactly determines a velocity of a moving object widely varied in velocity.

It is also an important object of the present invention to provide a method for correcting the velocity of the moving object.

It is also an important object of the present invention to provide a keyboard musical instrument, which accurately imparts loudness to a sound through accurately determining the velocity of hammer assemblies.

In accordance with one aspect of the present invention, there is provided a velocity calculating system for a moving object comprising a member having more than two detectable positions defined thereon, spaced from one another in a direction of the moving object and defining plural distances different in value, a sensor monitoring the member, and changing a detecting signal at each of the more than two detectable positions, one of the member and the sensor being connected to the moving object, the other of the member and the sensor being stationary with respect to the moving object, and an information processor connected to the sensor, determining lapses of time for the plural distances, and calculating a velocity on the basis of one of the plural distances when the moving object is moved at a relatively high speed and the velocity on the basis of another of the plural distances shorter than aforesaid one of the plural distances when the moving object is moved at a relatively low speed.

In accordance with another aspect of the present invention, there is provided a method for determining a velocity of a moving object comprising the steps of a) determining a first velocity in a first distance on a trajectory of the moving object and a second velocity in a second distance shorter than the first distance on the trajectory, and b) determining one of the first velocity and the second velocity to be a representative velocity of the moving object depending upon the velocity of the moving object.

In accordance with yet another aspect of the present invention, there is provided a keyboard musical instrument comprising a keyboard having plural keys movable between respective rest positions and respective end positions, plural hammers respectively associated with the plural keys, and driven for rotation for generating tones, an action mechanism provided between the plural keys and the plural hammers for transferring motions of the plural keys to the plural hammers, a velocity calculating system including plural hammer sensors respectively associated with the plural hammers, each of the plural hammer sensors having a rigid member provided with plural detectable positions spaced from one another along a trajectory of associated one of the plural hammers and defining plural distances and a sensor monitoring the rigid member and changing a hammer position signal at every detectable position, one of the rigid member and the sensor being connected to aforesaid associated one of the plural hammers, the other of the rigid member and the sensor being stationary with respect to aforesaid associated one of the plural hammers, plural key sensors respectively associated with the plural keys and respectively monitoring the associated keys for varying key position signals depending upon the actual key positions of the associated keys and an information processor connected to each of the key sensors so as to calculate a key velocity of associated one of the plural keys depressed by a player and each of the plural hammer sensors so as to calculate a first hammer velocity on the basis of one of the plural distances and a first lapse of time thereover and a second hammer velocity on the basis of another of the plural distances shorter than aforesaid one of the plural distances and a second lapse of time thereover and determining one of the first hammer velocity and the second hammer velocity to be a representative hammer velocity depending upon the value of the key velocity, and a music data information generator connected to the information processor and generating pieces of music data information representative of the keys depressed by the player and the loudness of the tones each proportional to the representative hammer velocity.

BRIEF DESCRIPTION OF THE DRAWINGS

The features and advantages of the velocity calculating system, the method and the keyboard musical instrument will be more clearly understood from the following description taken in conjunction with the accompanying drawings in which.

DESCRIPTION OF THE PREFERRED EMBODIMENTS

Structure of Keyboard Musical Instrument

Figure 4:
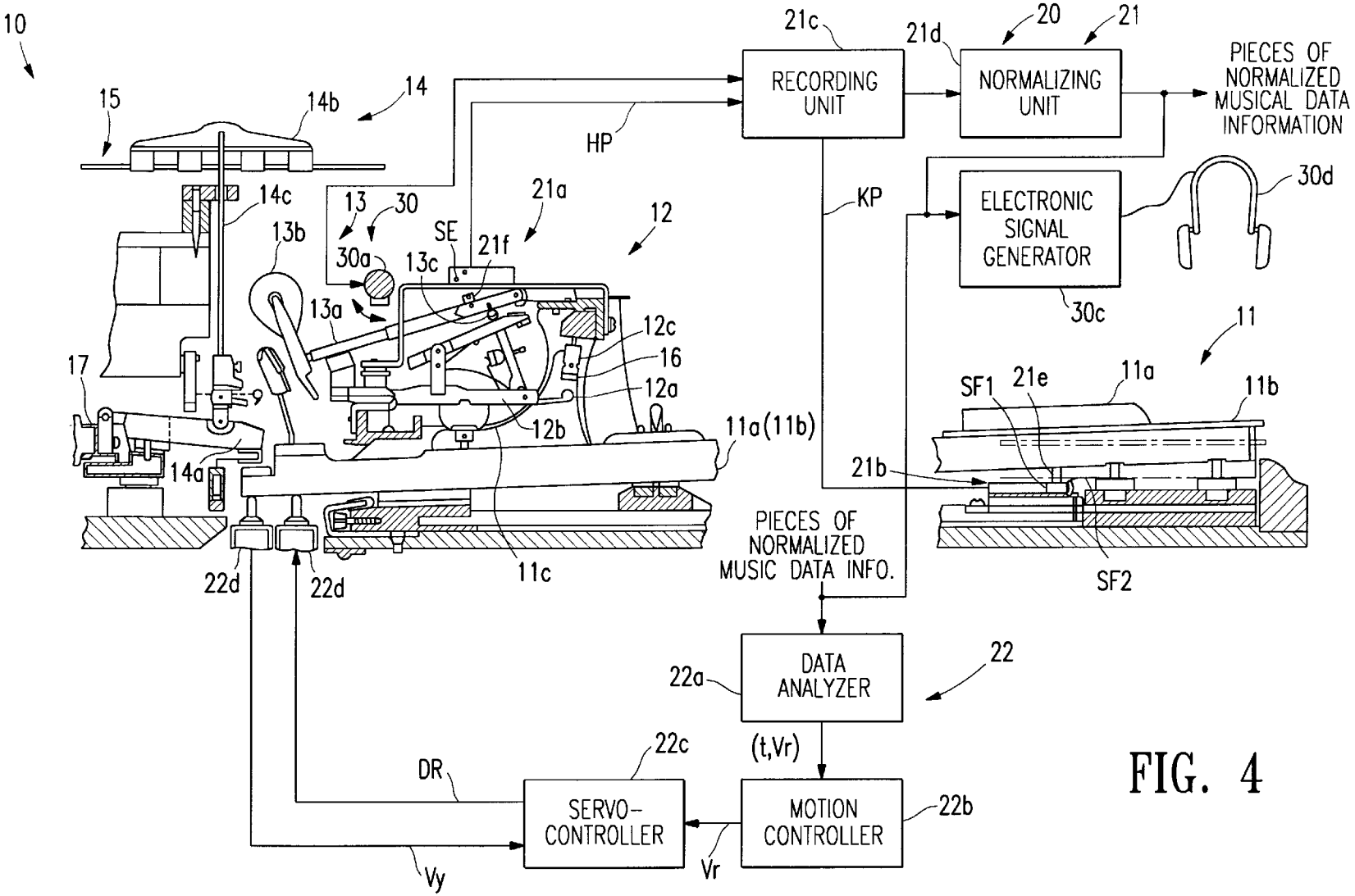
FIG. 4 is a schematic view showing an automatic player piano according to the present invention.

Referring to FIG. 4 of the drawings, an automatic player piano embodying the present invention largely comprises an acoustic piano 10, an automatic playing system 20 and a silent system 30. In this instance, the acoustic piano 10 is a grand piano. However, an upright piano is available for the automatic player piano according to the present invention. In the following description, the term "front" means a position closer to a pianist than a "rear" position.

The acoustic piano 10 is broken down into a keyboard 11, key action mechanisms 12, hammer assemblies 13, damper mechanisms 14, sets of strings 15 and pedal mechanisms (not shown). Black keys 11*a* and white keys 11*b* are laid on the well-known pattern, and form in combination the keyboard 11. In this instance, eighty-eight black/white keys 11*a*/11*b* form in combination the keyboard 11. The self-weight of each black/white key 11*a*/11*b* keeps the black/white key 11*a*/11*b* at a rest position. When force is exerted on the front portion of the black/white key 11*a*/11*b*, the black/white key 11*a*/11*b* is downwardly moved, and reaches an end position.

The key action mechanisms 12 are respectively associated with the black/white keys 11*a*/11*b*. The key action mechanism 12 includes a jack 12*a* turnable around a whippen assembly 12*b* and a regulating button 12*c*. Each of the hammer assemblies 13 is associated with one of the key action mechanisms 12 and one of the sets of strings 15. The hammer assemblies 13 are driven for rotation by the associated key action mechanisms 12 actuated by the black/white keys 11*a*/11*b*, respectively. The hammer assembly 13 includes a hammer shank 13*a* turnable with respect to action brackets 16, a hammer head 13*b* attached to the leading end of the hammer shank 13*a* and a hammer roller 13*c* connected to the hammer shank 13*a*. When the associated black/white key 11*a*/11*b* is in the rest position, the hammer roller 13*c* is held in contact with the jack 12*b*. Each of the damper mechanisms 14 is associated with one of the black/white keys 11*a*/11*b* and one of the sets of strings 15, and the associated black/white key 11*a*/11*b* spaces the damper mechanism 14 from and bring it into contact with the associated set of strings 15. The damper mechanism 14 includes a damper lever 14*a* turnable with respect to a damper rail 17 a damper head 14*b* spaced from and brought into contact with the associated set of strings 15 and a damper wire 14*c* connected between the damper lever 14*a* and the damper head 14*b*.

A capstan button 11*c* projects from the rear portion of the black and white key 11*a*/11*b*, and is held in contact with the whippen assembly 12*b*. While the black/white key 11*a*/11*b* is being depressed from the rest position toward the end position, the capstan button 11*c* upwardly pushes the whippen assembly 12*b*, and the whippen assembly 12*b* turns in the counter clockwise direction together with the jack 12*a*. The black/white key 11*a*/11*b* further pushes the damper lever 14*a* upwardly, and causes the damper lever 14*a* to turn in the counter clockwise direction. The damper lever 14*a* lifts the damper head 14*b*, and the damper head 14*b* is separated from the set of strings 15. The set of strings 15 is ready for vibrations.

The jack 12*a* is brought into contact with the regulating button 12*c* at the toe thereof, and turns in the clockwise direction around the whippen assembly 12*b*. Then, the hammer roller 13*c* escapes from the jack 12*a*, and the hammer assembly 13 starts a free rotation toward the associated set of strings 15. The hammer head 13*b* strikes the set of strings 15, and the strings 15 vibrate for generating an acoustic tone.

When the depressed black/white key 11*a*/11*b* is released, the black/white key 11*a*/11*b* starts to return to the rest position, and allows the damper lever 14*a* to turn in the clockwise direction. The damper head 14*b* is brought into contact with the set of strings 15, again, and damps the vibrations of the strings 15. Thus, the acoustic piano 10 generates the acoustic tone as similar to a standard grand piano.

The automatic playing system 20 is broken down into a recording sub-system 21 and a playback sub-system 22. The recording sub-system 21 comprises plural hammer sensors 21*a* respectively associated with the hammer assemblies 13, plural key sensors 21*b* respectively associated with the black/white keys 11*a*/11*b*, a recording unit 21*c* connected to the hammer sensors 21*a* and the key sensors 21*b* for generating pieces of music data information and a normalizing unit 21*d* for producing pieces of normalized music data information.

Each of the key sensors 21*b* has a shutter plate 21*e* attached to the lower surface of the associated black/white key 11*a*/11*b* and two photo sensors SF1 and SF2 spaced along the trajectory of the associated black/white key 11*a*/11*b*. The photo sensors SF1/SF2 are connected to the recording unit 21*c*, and supply a key position signal KP to the recording unit 21*c*. The recording unit 21*c* determines a depressing time tk at which a player depresses the black/white key 11*a*/11*b*, a depressed key velocity Vk on the way toward the end position, a releasing time at which the black/white key 11*a*/11*b* is released and a release key velocity on the way toward the rest position.

Each of the hammer sensors 21*a* has a shutter plate 21*f* and a photo sensor SE, and the photo sensor SE is connected to the recording unit 21*c* so as to supply a hammer position signal HP thereto. The shutter plates 21*f* are substantially rigid, and the edge lines H1, H2, H3 and H4 are unchanged. The recording unit 21*c* calculates a shutter velocity and, accordingly, a hammer velocity V0/V1 on the basis of the hammer position signal HP, and determines an impact time at which the hammer head 13*b* strikes the associated set of strings 15 for generating the acoustic tone. Thus, the recording unit 21*c* generates pieces of music data information representative of the performance, and the pieces of music data information are supplied to the normalizing unit 21*d*. The normalizing unit 21*d* eliminates the individuality of the automatic player piano from the pieces of music data information, and produces pieces of normalized music data information from the pieces of music data information. The pieces of normalized music data information are stored in a suitable data storage (not shown) such as, for example, a floppy disk, a hard disk, an optical disk or a semiconductor memory device, and/or are transferred through a data communication network (not shown).

Figure 5:
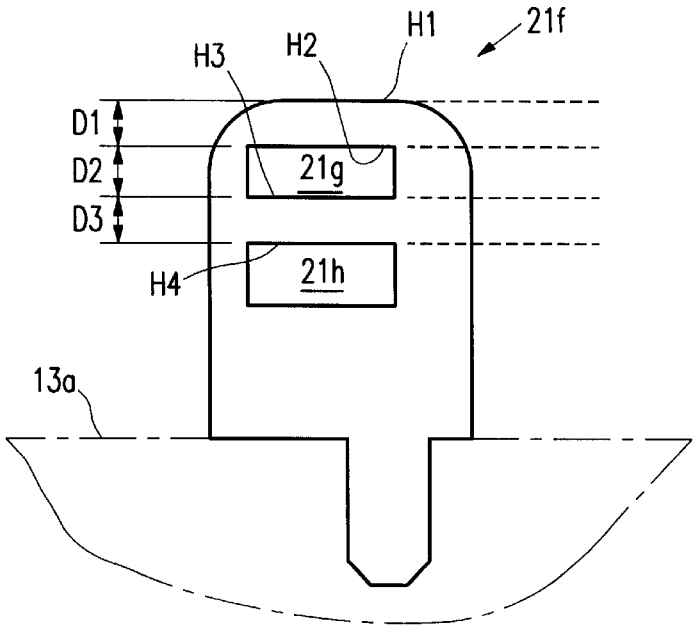
FIG. 5 is a front view showing a shutter plate forming a part of a hammer sensor incorporated in the automatic player piano.

The shutter plate 21*f* is attached to the hammer shank 12*a*, and has two windows 21*g*/21*h* as shown in FIG. 5. The shutter plate 21*f* has a leading edge H1 farthest from the hammer shank 13*a*. Two edge lines and two side lines define the window 21*g*. The edge line closer to the leading edge H1 is labeled with "H2", and the other edge line is labeled with "H3". Similarly, the window 21*h* has two edge lines and two side lines. The edge line closer to the window 21*g* is labeled with "H4". The distances D1/D2/D3 between the edge lines H1, H2, H3 and H4 are strictly determined. In this instance, the distance D1 between the leading end line H1 and the edge line H2 is 1.0 millimeter, the distance D2 between the edge lines H2 and H3 is also 1.0 millimeter, and the distance between the edge lines H3 and H4 is also 1.0 millimeter.

While the recording system 21 is recording a performance without any interference of the shank stopper 30*a*, the recording unit 21*c* calculates the hammer velocity for a strongly depressed black/white key 11*a*/11*b* on the basis of the lapse of time between the edge lines H2 and H4 and the hammer velocity for a softly depressed black/white key 11*a*/11*b* on the basis of the lapse of time between the edge lines H3 and H4. The distance between the edge lines H2 and H4 is 2 millimeters, and the long distance makes the resolution of the hammer velocity high. Thus, even if the player strongly depresses the black/white key 11*a*/11*b*, the hammer sensor 21*a* permits the recording unit 21*c* to determines the hammer velocity at the high resolution, and the piece of music data information representative of the final hammer velocity or the loudness is reliable. On the other hand, when the player softly depresses the black/white key 11*a*/11*b*, the hammer velocity is relatively low, and the short distance does not lower the resolution. The recording unit 21*c* calculates the hammer velocity on the basis of the lapse of time between the edge line H3 and the edge line H4, and the hammer velocity is closer to the final hammer velocity rather than the hammer velocity for the strongly depressed black/white key 11*a*/11*b*. Thus, the recording unit 21*c* calculates the hammer velocity on the basis of the lapse of time between two edge lines appropriate to the key motion.

On the other hand, while the recording system 21 is recording a performance without any acoustic tones, i.e., under the shank stopper 30*a* in the blocking position, the recording unit 21*c* calculates the hammer velocity for a strongly depressed black/white key 11*a*/11*b* on the basis of the lapse of time between the edge lines H1 and H3 and the hammer velocity for a softly depressed black/white key 11*a*/11*b* on the basis of the lapse of time between the edge lines H2 and H3. This is because of the fact that the hammer assemblies 13 rebound on the shank stopper 30*a*, and the shutter plates 21*f* start to return before the turning points of the shutter plates 21*f* in the key motion without any interference of the shank stopper 30*a*. In other words, the edge line H4 does not reach the photo sensor SE. For this reason, the long distance is defined between the edge lines H1 and H3, and the short distance is defined between the edge lines H3 and H4. Using the two kinds of distance, the recording unit 21*c* enhances the resolution for the strongly depressed black/white key 11*a*/11*b*, and makes the hammer velocity for the softly depressed black/white key 11*a*/11*b* close to the final hammer velocity.

The playback sub-system 22 includes a data analyzer 22*a*, a motion controller 22*b*, a servo-controller 22*c* and solenoid-operated key actuators 22*d*. Velocity sensors are incorporated in the solenoid-operated key actuators 22*d*, respectively, and supply plunger signals Vy representative of actual velocity of the plungers to the servo-controller 22*c*. Pieces of normalized music data information representative of a performance are supplied from the data storage (not shown) or a real-time communication system (not shown) to the data analyzer 22*a*. The data analyzer 22*a* analyzes the pieces of normalized music data information, and determines a target key velocity Vr on a trajectory of each black/white key 11*a*/11*b* to be reproduced in the playback, and the target key velocity Vr is varied with time t. Thus, the data analyzer 22*a* produces a series of target key velocity data (t, Vr) from the pieces of normalized music data information, and supplies the series of target velocity data (t, Vr) to the motion controller 22*b*. The motion controller 22*b* determines the target key velocity varied together with the key position on the trajectory of the black/white key 11*a*/11*b*, and instructs an amount of driving current appropriate to the target key velocity Vr to the servo-controller 22*c* for each of the black/white keys 11*a*/11*b* to be moved. The servo-controller 22*c* is responsive to the instruction of the motion controller 22*b* so as to supply a driving signal DR to the solenoid-operated key actuator 22*d* associated with the black/white key 11*a*/11*b* to be moved. While the solenoid-operated key actuator 22*d* is projecting the plunger thereof, the associated black/white key 11*a*/11*b* is moved so as to actuate the associated key action mechanism 12, and the velocity sensor reports the actual plunger velocity Vy to the servo-controller 22*c*. The servo-controller 22*c* compares the actual plunger velocity Vy with the target key velocity, i.e., the target plunger velocity to see whether or not the actual plunger velocity Vy is equal to the target key velocity Vr. If the actual plunger velocity Vy is different from the target key velocity Vy, the servo-controller 22*c* increases or decreases the amount of current.

The silent system 30 includes a shank stopper 30*a*, an electric motor (not shown) connected to the shank stopper 30*a*, a position sensor (not shown) for detecting the current position of the shank stopper 30*a*, an electronic signal generator 30*c* and a headphone 30*d*. When a pianist manipulates a switch, the electric motor changes the shank stopper 30*a* between a free position and a blocking position. The hammer shanks 13*a* rebound on the shank stopper 30*a* in the blocking position before the hammer heads 13*b* strike the associated sets of strings 15. On the other hand, when the shank stopper 30*a* is in the free position, the hammer heads 13*b* strike the associated sets of strings 15 without any interference of the shank stopper 30*a*. Thus, the silent system 30 allows the pianist to finger on the keyboard 11 without acoustic tones. While the player is playing a tune on the keyboard 11, the electronic signal generator 30*c* produces an audio signal from the pieces of normalized music data information, and supplies the audio signal to the headphone 30*d*. Then, the headphone 30*d* generates electronic sounds corresponding to the acoustic tones to be generated by the strings 15. In the following description, a performance without any interference of the shank stopper 30*a* is referred to as "standard performance", and a performance under the shank stopper 30*a* in the blocking position is referred to as "silent performance".

Correction Factor for Hammer Velocity

The recording unit 21*c* calculates the hammer velocity on the basis of the lapse of time between the selected edge lines as described hereinbefore. However, if the calculated hammer velocity is considered to contain an error, the recording unit 21*c* corrects the calculated hammer velocity. The recording unit 21*c* determines a correction factor C, and multiples the calculated hammer velocity by the correction factor C. Then, the error is eliminated from the hammer velocity. The correction factor C is determined as follows.

Figure 6:
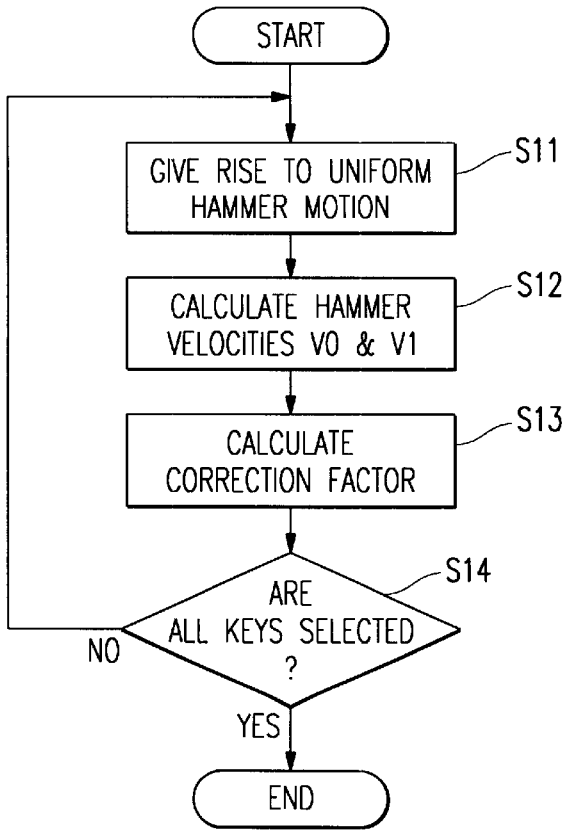
FIG. 6 is a flow chart showing a method for determining a correction factor for the hammer velocity.

FIG. 6 illustrates a method for determining the correction factor C. The automatic playing system 20 selects one of the black/white keys 11*a*/11*b*, and gives rise to a uniform motion of the hammer assembly 13 associated with the selected black/white key 11*a*/11*b* as by step SP11. The shank stopper 30*a* is in the free position, and the hammer head 13*b* is to strike the associated set of strings 15.

One of the techniques for the uniform hammer motion is the servo-control under the pieces of normalized music data information representative of a predetermined key motion. When the pieces of normalized music data information representative of the predetermined key motion are given to the data analyzer 22*a*, the data analyzer 22*a* instructs the motion controller 22*b* to move the selected black/white key 11*a*/11*b* along the trajectory, and the servo-controller 22*c* forces the plunger velocity and, accordingly, the selected black/white key 11*a*/11*b* to trace the given trajectory. The motion of the selected black/white key 11*a*/11*b* results in the uniform hammer motion. If the selected black/white key 11*a*/11*b* is depressed at a target key velocity Vr, the selected black/white key 11*a*/11*b* gives rise to a uniform hammer motion. Otherwise, a weight is dropped, the black/white key connected thereto tends to give rise to a uniform hammer motion. Any key depressing technique is available for the method in so far as the key depressing technique results in a uniform hammer motion.

While the hammer assembly 13 is moving in the uniform motion, the edge lines H1/H2/H3/H4 of the shutter plate 21*f* successively intersect the optical beam of the photo sensor SE, and the photo sensor SE reports the intersection to the recording unit 21*c* through the hammer position signal HP. The recording unit 21*c* calculates a hammer velocity V0 on the basis of the lapse of time between the edge line H2 and the edge line H4 and a hammer velocity V1 on the basis of the lapse of time between the edge line H3 and the edge line H4 as by step S12.

If the shutter plate is machined in compliance with the design specification, the hammer velocity V0 is equal to the hammer velocity V1. However, the actual distance between the edge lines H3 and H4 may be different from the distance in the design specification. In this situation, the recording unit 21*c* calculates the correction factor C for the selected black/white key 11*a*/11*b* as by step S13.

$$C=dX'/dX=V0''/V1''$$

where dX is the distance in the design specification, dX' is the actual distance, V0" is the hammer velocity in a uniform motion corresponding to the hammer velocity V0 and V1" is the hammer velocity in the uniform motion corresponding to the hammer velocity V1. The actual distance between the edge line H2 and the edge line H4 is assumed to be the distance in the design specification.

The automatic playing system 20 checks the data storage to see whether or not the correction factor C has been calculated for all the black/white keys 11*a*/11*b* as by step S14. If there is non-selected black/white key 11*a*/11*b*, the answer at step S14 is given negative, and the control returns to step S11. The automatic playing system 20 reiterates the loop consisting of steps S1 to S14 for calculating the correction factor C for all the black/white keys 11*a*/11*b*. When the correction factor C is determined for all the black/white keys 11*a*/11*b*, the answer at step S14 is changed to affirmative, and the method reaches "END". In this instance, the eighty-eight black/white keys 11*a*/11*b* form the keyboard 11, and the correction factor C is subscripted with 1 to 88, i.e., C1 to C88.

Recording Mode

Figure 7:
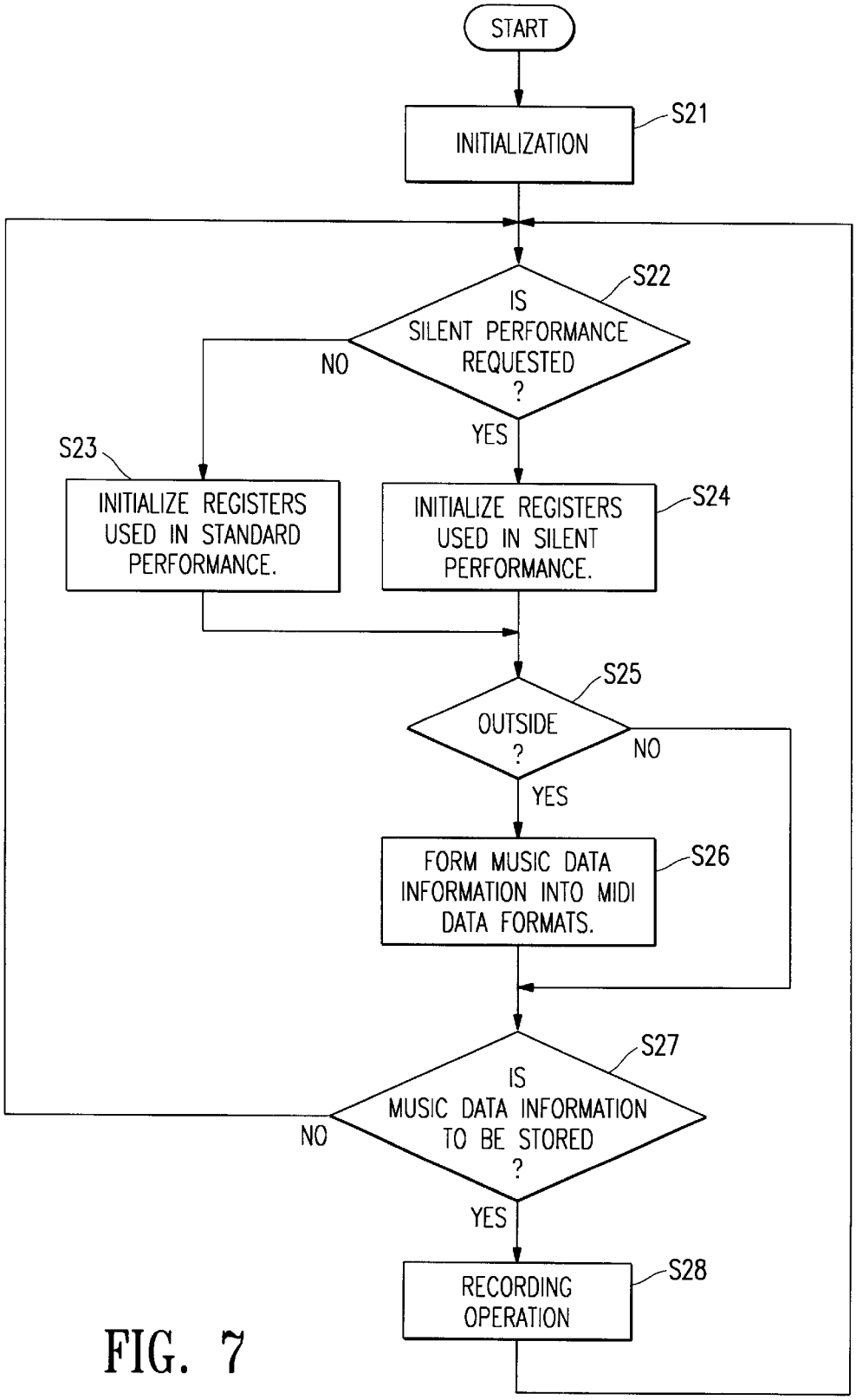
FIG. 7 is a flow chart showing a computer program for a recording unit.

The automatic player piano behaves in the recording mode as follows. The recording sub-system 21 includes data processors (not shown), and the data processors run a computer program shown in FIG. 7. When the recording unit 21*c* is powered, the data processor initializes internal/external registers (not shown), and changes the shank stopper 30*a* to the free position, if necessary, as by step S21. The pianist gives various instructions to the recording system 21 through a manipulating board (not shown).

Subsequently, the data processor checks the instructions to see whether or not the player instructed the silent system 30 to change the shank stopper 30*a* to the blocking position as by step S22. If the pianist wants the standard performance, the data processor proceeds to step S23, and initializes the registers used in the standard performance. If the registers used in the standard performance have been already initialized, the data processor skips step S23. On the other hand, if the pianist wants the silent performance, the data processor initializes registers used in the silent performance, and changes the shank stopper 30*a* to the blocking position as by step S24.

Subsequently, the data processor checks the instructions to see whether or not the pianist requested the recording system 21 to supply the pieces of normalized music data information to the outside thereof as by step S25. If the recording system 21 was requested to supply the pieces of normalized music data information to the outside, the answer at step SP25 is given affirmative, and the data processor instructs the normalizing unit 21*d* to form the pieces of music data information into the data formats defined in the MIDI (Musical Instrument Digital Interface) standards as by step S26. On the contrary, when the recording system 21 was not instructed to supply the pieces of music data information to the outside, the answer at step S25 is given negative, and the data processor proceeds to step S27 without execution of step S26.

The data processor checks the instructions to see whether or not the pianist requested the normalizing unit 21*d* to store the pieces of normalized music data information in the data storage as by step S27. If the pianist did not want any recording, the answer at step S27 is given negative, and the data processor returns to step S22. On the other hand, if the pianist wanted the normalizing unit 21*d* to store the pieces of normalized music data information in the data storage, the answer at step S27 is given affirmative, and the data processor proceeds to step S28 for recording the pieces of normalized music data information as by step S28. Thereafter, the data processor returns to step S22, and reiterates the loop consisting of steps S22 to S28. The recording operation is hereinbelow described in detail.

While a pianist is playing a tune on the keyboard 11 in the recording mode, the key sensors 21*b* and the hammer sensors 21*a* monitor the associated black/white keys 11*a*/11*b* and the associated hammer assemblies 13, and periodically supply the key position signals KP and the hammer position signals HP to the recording unit 21*c*.

The recording unit 21*c* checks the key position signals KP to see whether or not the pianist depresses any black/white keys 11*a*/11*b* and whether or not the pianist releases the depressed black/white keys. When one of the black/white keys 11*a*/11*b* is depressed and, thereafter, released, the recording unit 21*c* determines the depressing time, the depressed key velocity, the releasing time and the released key velocity, and generates pieces of music data information representative of them. The releasing time is corresponding to the note-off data defined in the MIDI standards.

The recording unit 21*c* further checks the hammer position signals HP to see whether or not the hammer assemblies 13 associated with the depressed keys 11*a*/11*b* pass the associated photo sensors SE. When the edges H1 to H4 of the shutter plate 21*f* successively intersects the optical beam of the photo sensor 21*f*, the photo sensor 21*f* changes the potential level of the hammer position signal HP between the high level and the low level, and the recording unit 21*c* calculates the hammer velocities V0/V1 on the basis of the lapses of time between the edge lines H2 and H4 and between the edge lines H3 and H4. The recording unit 21*c* further determines the impact time on the basis of the hammer position signal HP, and the impact time is corresponding to the note-on data defined in the MIDI standards. The recording unit 21*c* produces the pieces of music data information representative of the final hammer velocity and the impact timing. Description on how the recording unit 21*c* determines the final hammer velocity is hereinlater described with reference to FIGS. 7 and 8. The note-on data and the note-off data are called as event data. If another event data has been stored for the same black/white key 11*a*/11*b*, the lapse of time from the previous event data is stored a duration. An event data and related data are referred to as "event frame".

Thus, the recording unit 21*c* determines the depressing time, the depressed key velocity, the releasing time, the released key velocity, the final hammer velocity, the impact time and the duration for each of the black/white keys 11*a*/11*b* depressed and, thereafter, released, and supplies the pieces of music data information representative of the timings, the velocities and the duration to the normalizing unit 21*d*. The normalizing unit 21*d* normalizes the pieces of music data information, and eliminates the individuality of the automatic player piano from the pieces of music data information. The pieces of normalized music data information are supplied from the normalizing unit 21*d* to the data storage, and are stored therein.

Figure 8:
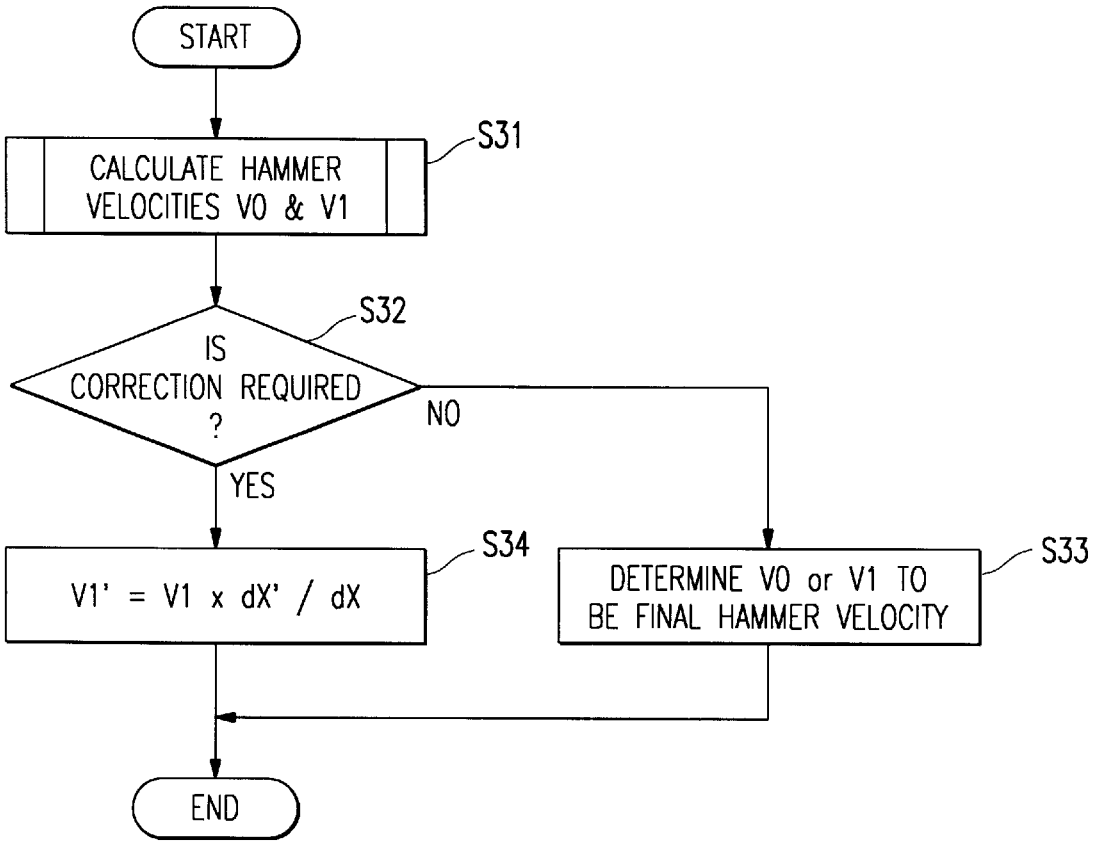
FIG. 8 is a flow chart showing a computer program for determining a final hammer velocity.
Figure 9:
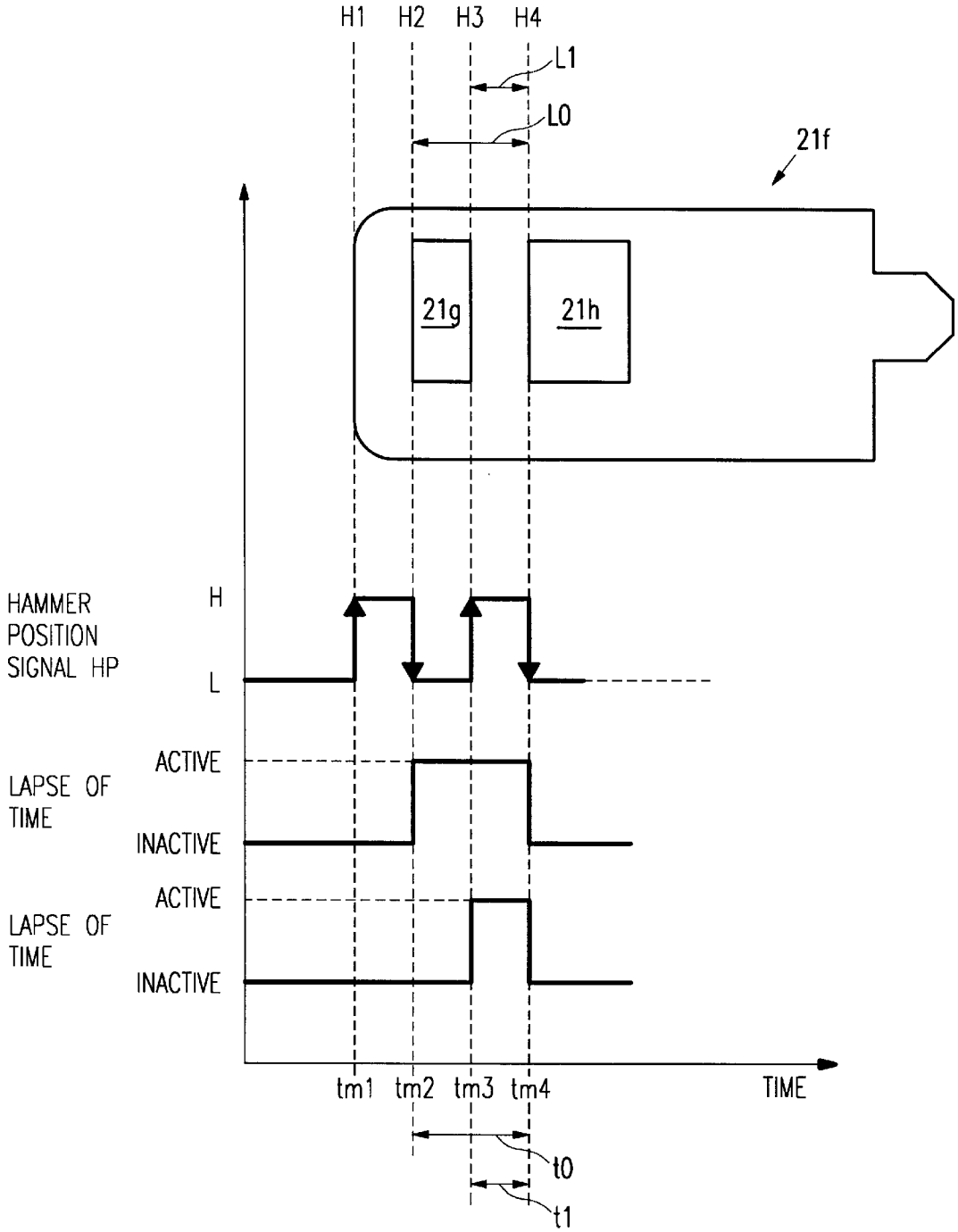
FIG. 9 is a graph showing the relation between edges of the shutter plate and the potential level of the hammer position signal.

Turning to FIGS. 8 and 9, the recording unit 21*c* firstly calculates the hammer velocity V0 on the basis of the lapse of time between the edge lines H2 and H4 and the hammer velocity V1 on the basis of the lapse of time between the edge lines H3 and H4 as by step S31.

In FIG. 9, the long distance between the edge lines H2 and H4 is labeled with L0, and the short distance between the edge lines H3 and H4 is labeled with L1. While the edge line H1 is on the way to the photo sensor SE, the photo sensor SE keeps the hammer position signal HP in the low level L. The edge line H1 intersects the optical path of the photo sensor SE at time tm1, and the photo sensor SE changes the hammer position signal HP from the low level L to the high level H. The shutter plate 21*f* continues to intersect the optical path between the edge lines H1 and H2, and the photo sensor SE keeps the hammer position signal HP in the high level. The edge line H2 reaches the optical path of the photo sensor SE at time tm2, and the photo sensor SE changes the hammer position signal HP to the low level. While the optical path is moving across the window 21*g*, the photo sensor SE keeps the hammer position signal HP in the low level L. The edge line H3 reaches the optical path at time tm3, and the photo sensor SE changes the hammer position signal HP to the high level H. The shutter plate 21*f* continues to intersect the optical path between the edge lines H3 and H4, and the photo sensor SE keeps the hammer position signal HP in the high level H. The edge line H4 reaches the optical path at time tm4, and the photo sensor SE changes the hammer position signal HP to the low level.

The recording unit 21*c* starts an internal clock at time tm2, and stops the internal clock at time t4. The lapse of time between the edge lines H2 and H4 is the difference between time tm4 and time tm2, and is represented by t0. Then, the recording unit 21*c* divides the long distance L0 by the lapse of time t0, and the quotient is indicative of the hammer velocity V0.

Similarly, the recording unit 21*c* starts another internal clock at time tm3, and stops it at time tm4. The lapse of time between the edge lines H3 and H4 is the difference between time tm4 and time tm3, and is represented by t1. Then, the recording unit 21*c* divides the short distance L1 by the lapse of time t1, and the quotient is indicative of the hammer velocity V1. Although the potential change at time tm3 is opposite to the potential change at time tm4, the difference between the signal rise and the signal decay is ignoreable, because the hammer velocity is slow.

Upon completion of the calculations, the recording unit 21*c* checks the hammer velocities V0 and V1 to see whether or not a correction is required as by step S32. If the recording unit 21*c* can not calculate one of the hammer velocities V0/V1, the recording unit 21*c* decides that any correction is not required. If at least one of the hammer velocities V0/V1 is larger in value than a predetermined maximum hammer velocity VREMAX, i.e., V0>VREMAX or V1>VREMAX, the recording unit 21*c* determines the associated black/white key 11*a*/11*b* to be strongly depressed, and decides that any correction is not required. If at least one of the hammer velocities V0/V1 is smaller in value than a predetermined minimum hammer velocity VREMIN, i.e., V0<VREMIN or V1<VREMIN, the recording unit 21*c* determines the associated black/white key 11*a*/11*b* to be softly depressed, and decides that a correction is required. Finally, if the absolute value of the difference between the hammer velocities V0 and V1 is larger than a standard velocity difference VDIF, i.e., $|V0-V1|>VDIF$, the recording unit 21*c* decides that the correction is required.

When the recording unit 21*c* decides that any correction is not required, the recording unit 21*c* proceeds to step S33, and determines the hammer velocity either V0 or V1 to be the final hammer velocity.

On the other hand, when the recording unit 21*c* decides that the correction is required, the recording unit 21*c* proceeds to step S34. The recording unit 21*c* multiplies the hammer velocity V1 by the correction factor C. i.e., $V1\times C=V1\times dX'/dX$. Then, the product is indicative of the corrected hammer velocity V1'. The recording unit 21*c* determines the corrected hammer velocity V1' to be the final hammer velocity.

When the pianist wants the silent performance, the recording system 21 behaves as similar to the above-described recording operation except the long distance and the short distance. In the silent performance, the long distance is between the edge lines H1 and H3, and the short distance is between the edge lines H2 and H3.

Playback Mode

Figure 10:
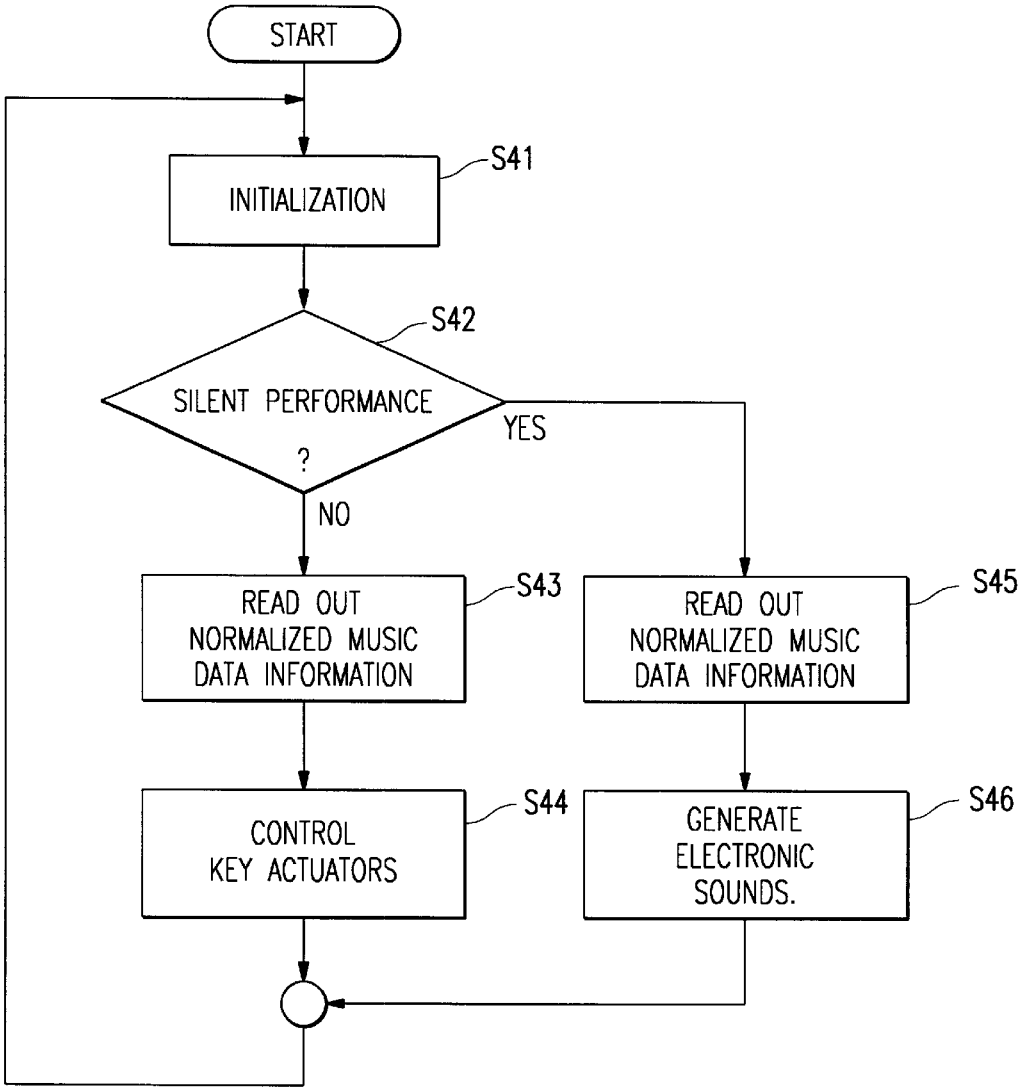
FIG. 10 is a flow chart showing a computer program for a playback sub-system.

FIG. 10 illustrates a computer program for the playback sub-system 22. Data processors are also incorporated in the playback sub-system 22. Assuming now that the pianist instructs the automatic playing system 20 to reproduce the performance already recorded, various instructions are given to the automatic playing system 20 through the manipulating board, and the data processor starts the computer program at "START". The data processor firstly initializes registers, and establishes the playback sub-system 22 in the standard performance mode as by step S41. A standard tempo is given to the playback sub-system 22 during the initialization.

Subsequently, the data processor checks the instructions to see whether or not the pianist requests the silent performance to the automatic playing system as by step S42. If the pianist instructed the automatic playing system 20 to reproduce the acoustic tones, the answer at step S42 is given negative, and the data processor transfers the pieces of normalized music data information from the data storage to a memory of the data analyzer 22*a* as by step S43. The pieces of normalized music data information are successively read out from the memory, and the data read-out is carried out through an interruption routine, and a tempo clock representative of the tempo gives timings for the interruption. In this instance, the interruption takes place twenty-four times per a quarter note. Assuming now that a piece of normalized music data information representative of an event accompanied with a duration data has been already read out from the memory, the data analyzer 22*a* decrements the duration data in synchronism with the tempo clock. When the duration data is decreased to zero, the data analyzer 22*a* reads out a piece of normalized music data information representative of the next event. Thus, the pieces of normalized music data information are read out in order of events. The data analyzer repeats the data read-out, and determines the trajectories of the black/white keys 11*a*/11*b*, i.e., the target key velocity Vr varied with time.

The data analyzer 22*a* supplies the target key velocity data to the motion controller 22*b*, and the motion controller 22*b* determines the target key velocity Vr at each key position on the basis of the target key velocity data. The motion controller 22*b* instructs the target key velocity Vr to the servo-controller 22*c*, and the servo-controller 22*c* energizes the solenoid-operated key actuators 22*d* as by step S44. In detail, the servo-controller 22*c* determines the magnitude of the driving signal DR corresponding to the given target key velocity Vr. The servo-controller 22*c* supplies the driving signal DR to the solenoid-operated key actuator 22*d* associated with the black/white key 11*a*/11*b* to be driven, and the solenoid-operated key actuator 22*d* projects the plunger so as to push up the rear portion of the black/white key 11*a*/11*b*. The black/white key 11*a*/11*b* actuates the associated key action mechanism 12, and the hammer assembly 13 escapes from the jack 12*b* of the key action mechanism 12. Then, the hammer assembly 13 starts the free rotation, and strikes the associated set of strings 15. The set of strings vibrates, and produces the acoustic tone. The hammer assembly rebounds on the set of strings 15, and returns to the initial position. While the solenoid-operated key actuator 22*d* is projecting the plunger, the built-in velocity sensor supplies the feedback signal representative of the actual velocity Vy to the servo-controller 22*c*. The servo-controller 22*c* compares the actual velocity Vy with the target key velocity Vr, and regulates the magnitude of the driving signal DR.

A delay time is unavoidable between the supply of power to the key actuator 22*d* and the strike with the hammer assembly 13. This means the sound generation is delayed from the read-out of an event frame. Moreover, the delay time is varied depending upon the hammer velocity. This results in the irregular time intervals between the generations of acoustic tones. The same problem is encountered in the releases of the black/white keys 11*a*/11*b*. In order to equalize the time intervals, the playback sub-system 22 introduces a constant time delay between the read-out of an event frame and the motion represented by the event frame, i.e., a strike with the hammer assembly 13 or a damp of the vibrations. In this instance, the constant time delay is 500 milliseconds. When an event frame is read out from the memory, the data analyzer 22*a* determines a trajectory of the black/white key 11*a*/11*b* to be depressed and, thereafter, a certain timing when the solenoid-operated key actuator is to start the key motion so as to strike the strings 15 or damp them 500 milliseconds after the read-out of the event frame. Thus, the playback sub-system 22 keeps the time intervals between the events equal to the duration data.

On the other hand, if the pianist instructed the silent performance to the automatic playing system 20, the answer at step S42 is given affirmative, and the pieces of normalized music data information are sequentially read out from the data storage as by step S45. The data read-out at step S45 is similar to the data read-out at step S43, and is carried out through the interruption routine.

The pieces of normalized music data information are supplied to the electronic signal generator 30*c*, and the electronic signal generator 30*c* produces an audio signal from the pieces of normalized music data information. The audio signal is supplied to the headphone 30*d* or a speaker system (not shown), and electronic sounds are generated through the headphone 30*d* or the speaker system as by step S46. In detail, the pieces of normalized music data information representative of a key code, a key-on, a key velocity and a key-off are supplied to a tone generator incorporated in the electronic signal generator 30*c*, and the tone generator generates tone signals through plural channels of the tone generator. The tone signals are mixed with each other so as to produce the audio signal. The pianist can selects another timbre of the electronic sounds through the manipulating board (not shown).

In the above-described embodiment, the shutter plate 21*f* is corresponding to a member, and the edge lines H1 to H4 serve as detectable positions, respectively. The recording unit 21*c* and the computer program shown in FIG. 8 as a whole constitute an information processor.

As will be understood from the foregoing description, the recording unit 21*c* calculates the hammer velocity on the basis of the long distance for a strongly depressed key and on the basis of the short distance for a softly depressed key. The long distance improves the resolution of the hammer velocity. The starting line of the short distance is closer to the hammer shank 13*a* than the starting line of the long distance, and the hammer velocity calculated on the basis of the short distance accurately represents the final hammer velocity.

When a pianist softly depresses a black/white key 11*a*/11*b*, the associated hammer assembly 13 is not always moved in the uniform motion. The slow hammer motion permits the recording unit 21*c* to ignore the difference between the signal rise time and the signal delay time. A high resolution is achieved in the slow hammer velocity. For this reason, the recording unit 21*c* calculates the hammer velocity on the basis of the short distance defined in the shutter plate 21*f*.

The light-to-current converting characteristics are dispersed between semiconductor photo-devices such as photo-detecting diodes . If a photo-detecting diode raises the hammer position signal gentler than the design characteristics, the photo-detecting diode consumes a time period until the threshold longer than the design time period. When the incident light is removed from the photo-detecting diode, the photo-diode decays the potential level of the hammer position signal under the threshold faster than the design time period. In this situation, if the distance L0 is defined between a signal rise and a signal decay, the deviation of the converting characteristics twice affect the time period t0, and makes the hammer velocity less reliable. When the light-to-current converting characteristics are widely varied due to aged deterioration, the influence is serious. In the above-described embodiment, the distance L0 is defined between the signal decays, the deviation of the converting characteristics at time tm2 is canceled with that at time t4, and the cancellation makes the hammer velocity reliable.

On the other hand, when a pianist strongly depresses a black/white key 11*a*/11*b*, the associated hammer assembly 13 tends to be moved in a uniform motion, and the difference between the signal rise time and the signal decay time is influential in the hammer velocity. The resolution is lowered together with the hammer velocity. For this reason, the recording unit 21*c* calculates the hammer velocity on the basis of the long distance defined in the shutter plate 21*f*.

Finally, when the long distance is changed to the short distance or the vice versa, the transition of the hammer position signal HP, i.e., from the low level L to the high level H or from the high level H to the low level L corrects the detected hammer velocity in the opposite section. As a result, the accuracy of the distance is maintained, and the detected hammer velocity is close to the final hammer velocity.

Although the particular embodiment of the present invention has been shown and described, it will be obvious to those skilled in the art that various changes and modifications may be made without departing from the spirit and scope of the present invention.

For example, a keyboard musical instrument according to the present invention may comprise an acoustic piano and the silent system 30. Another keyboard musical instrument may have an acoustic piano and the automatic playing system 20. The photo sensor may be replaced with another kind of sensor such as, for example, a magnetic sensor.

First Modification

Figure 1:
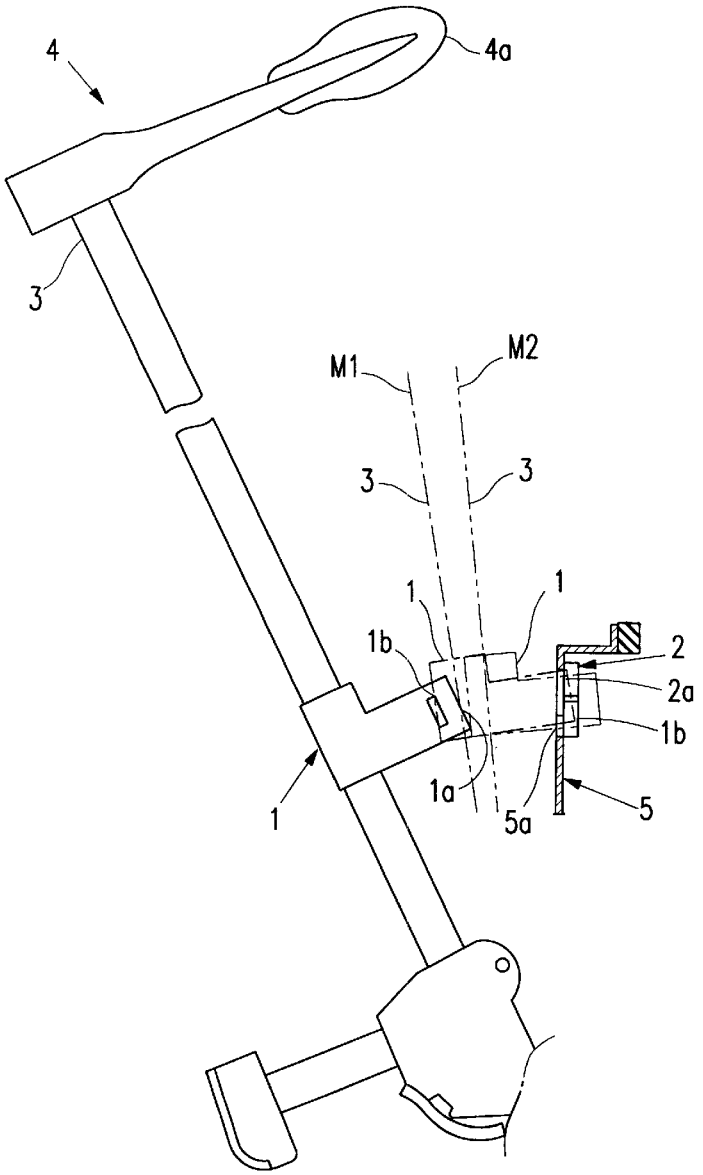
FIG. 1 PRIOR ART
FIG. 1 is a side view showing the hammer sensor incorporated in the prior art automatic player piano of the type having the upright piano.
Figure 2:
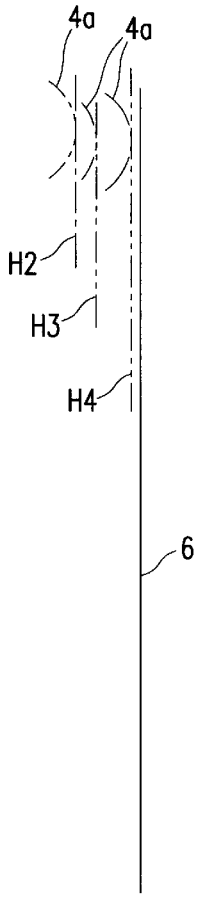
FIG. 2 PRIOR ART
FIG. 2 is a view showing the relation between the hammer position and the shutter position.
Figure 3:
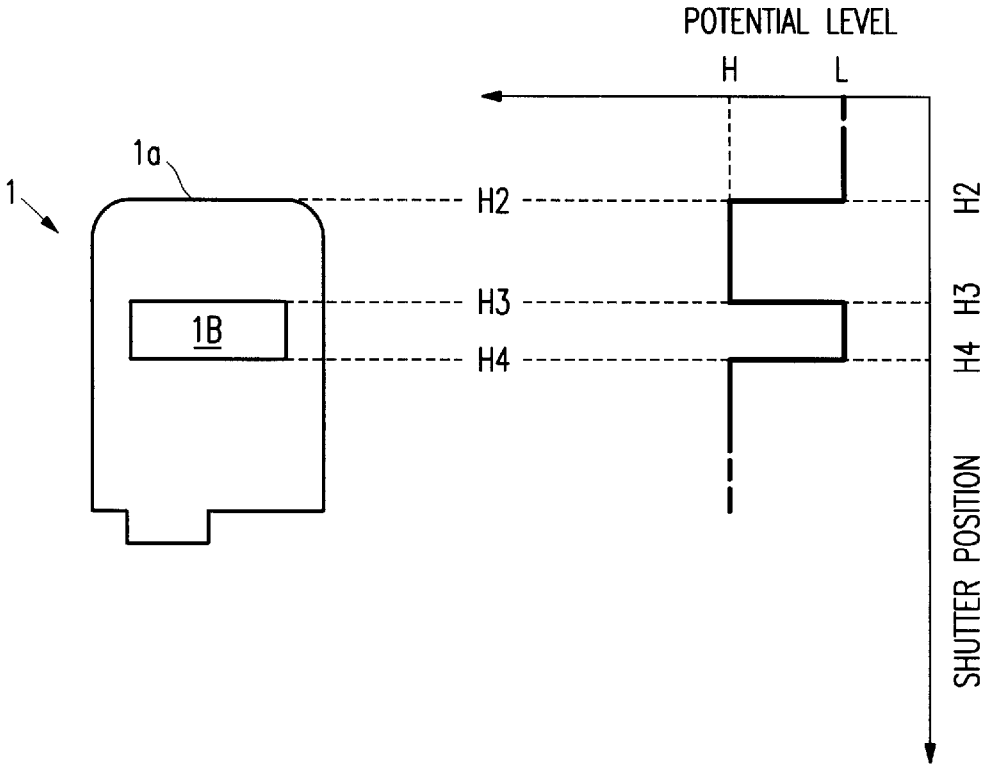
FIG. 3 PRIOR ART
FIG. 3 is a view showing the relation between the shutter position and the hammer position signal.

In the embodiment shown in FIG. 4, the shutter plate 21*f* has two windows 21*g*/21*h*, and the edge lines H1/H2/H3/H4 define the long distances and the short distances. However, two kinds of distances are not always defined by using the windows 21*g*/21*h*. If only one window is formed in the shutter plate as shown in FIG. 3, the edge lines H3 and H4 and the edge lines H2 and H4 may define the short distance and the long distance. When the recording unit 21*c* discriminates three kinds of key motion, i.e., a high-speed key motion, a middle-speed key motion and a low-speed key motion, the shutter plate 21*f* provides a long distance, a middle distance and a short distance for the calculation of the hammer velocity. More than one photo sensor may define plural distances.

Second Modification

Another shutter plate may have a bar code, comb-like slits or plural reflecting ribbons.

Third Modification

The hammer sensor 21*a* and the computer program shown in FIG. 8 are available for determination of a widely variable velocity. The hammer sensor 21*a* may be used as the key sensor.

Fourth Embodiment

The shutter plate 21*f* and the photo sensor SE may be exchangeable. In this instance, the photo sensor SE is attached to the hammer shank 13*a*, and the shutter plate 21*f* is fixed to the stationary bracket.

What is claimed is:

1. A velocity calculating system for a moving object, comprising:

a member having more than two detectable positions defined thereon, spaced from one another in a direction of said moving object and defining plural distances different in value and partially overlapping with one another;

a sensor monitoring said member, and changing a detecting signal at each of said more than two detectable positions, one of said member and said sensor being connected to said moving object, the other of said member and said sensor being stationary with respect to said moving object; and an information processor connected to said sensor, determining lapses of time for said plural distances, and calculating a velocity on the basis of one of said plural distances when said moving object is moved at a relatively high speed and said velocity on the basis of another of said plural distances shorter than said one of said plural distances when said moving object is moved at a relatively low speed.

2. The velocity calculating system as set forth in claim 1, in which said information processor further compares a velocity with a critical value to see whether or not said velocity is reliable, and corrects said velocity when the comparison results in a negative answer.

3. The velocity calculating system as set forth in claim 2, in which said information processor calculates a difference between said velocity calculated on the basis of said one of said plural distances to see whether or not said difference is larger than said critical value indicative of the maximum difference.

4. The velocity calculating system as set forth in claim 3, in which said information processor multiplies said velocity by a correction factor so as to correct said velocity.

5. The velocity calculating system as set forth in claim 4, in which said moving object is moved in a uniform motion, and said correction factor is a ratio between a target value of said another of said plural distances and an actual value of said another of said plural distances.

6. The velocity calculating system as set forth in claim 2, in which said information processor compares said velocity calculated on the basis of said one of said plural distances and said velocity calculated on the basis of said another of said plural distances with said critical value representative of the maximum hammer velocity to be allowed to see whether or not said velocity is reliable.

7. The velocity calculating system as set forth in claim 6, in which said information processor multiplies said velocity by a correction factor so as to correct said velocity.

8. The velocity calculating system as set forth in claim 7, in which said moving object is moved in a uniform motion, and said correction factor is a ratio between a target value of said another of said plural distances and an actual value of said another of said plural distances.

9. A method for determining a velocity of a moving object, comprising the steps of;

a) determining a first velocity in a first distance on a trajectory of said moving object and a second velocity in a second distance shorter than said first distance on said trajectory; and b) determining one of said first velocity and said second velocity to be a representative velocity of said moving object depending upon the velocity of said moving object.

10. The method as set forth in claim 9, further comprising the step of c) multiplying said second velocity by a correction factor so as to correct said representative velocity when said second velocity is selected in said step b).

11. The method as set forth in claim 10, in which said correction factor is a ratio of a designed value of said second distance to an actual value of said second distance.

12. A keyboard musical instrument comprising:

a keyboard having plural keys movable between respective rest positions and respective end positions;

plural hammers respectively associated with said plural keys, and driven for rotation for generating tones;

an action mechanism provided between said plural keys and said plural hammers for transferring motions of said plural keys to said plural hammers;

a velocity calculating system including plural hammer sensors respectively associated with said plural hammers, each of said plural hammer sensors having a rigid member provided with plural detectable positions spaced from one another along a trajectory of associated one of said plural hammers and defining plural distances and a sensor monitoring said rigid member and changing a hammer position signal at every detectable position, one of said rigid member and said sensor being connected to said associated one of said plural hammers, the other of said rigid member and said sensor being stationary with respect to said associated one of said plural hammers, plural key sensors respectively associated with said plural keys and respectively monitoring said associated keys for varying key position signals depending upon the actual key positions of said associated keys, and an information processor connected to each of said key sensors so as to calculate a key velocity of associated one of said plural keys depressed by a player and each of said plural hammer sensors so as to calculate a first hammer velocity on the basis of one of said plural distances and a first lapse of time thereover and a second hammer velocity on the basis of another of said plural distances shorter than said one of said plural distances and a second lapse of time thereover and determining one of said first hammer velocity and said second hammer velocity to be a representative hammer velocity depending upon the value of said key velocity; and a music data information generator connected to said information processor and generating pieces of music data information representative of the keys depressed by said player and the loudness of said tones each proportional to said representative hammer velocity.

13. The keyboard musical instrument as set forth in claim 12, in which said information processor checks said first velocity and said second velocity to see whether said first velocity and said second velocity are reliable, and corrects said second velocity when said information processor selects said second velocity with a negative answer.

14. The keyboard musical instrument as set forth in claim 13, in which said information processor corrects said second velocity by multiplying said second velocity by a correction factor, and said correction factor is a ratio between an actual value of said another of said plural distances and a designed value of said another of said plural distances.

15. The keyboard musical instrument as set forth in claim 14, further comprising a playback system including plural key actuators associated with said plural keys and another information processor determining the magnitude of driving signals on the basis of said pieces of music data information and supplying said driving signals to the key actuators associated with the keys to be driven.

16. The keyboard musical instrument as set forth in claim 14, further comprising a silent system including a hammer stopper changed between a free position and a blocking position, said hammer stopper in said free position allowing said hammers to generate said tones through vibrations of associated strings, said hammer stopper in said blocking position causing said hammers to rebound thereon before striking said strings, and an electronic sound generator connected to said music data information generator for generating electronic sounds.

17. The keyboard musical instrument as set forth in claim 16, in which said silent system informs said information processor that said hammer stopper is presently in one of said free position and said blocking position, and said information processor calculates said first hammer velocity on the basis of yet another of said plural distances and said second hammer velocity on the basis of still another of said plural distances shorter than said yet another of said plural distances, said sensor reaching said yet another of said plural distances and said still another of said plural distances later than said one of said plural distances and said another of said plural distances, respectively.

18. The keyboard musical instrument as set forth in claim 14, further comprising:

a playback system including plural key actuators associated with said plural keys and another information processor determining the magnitude of driving signals on the basis of said pieces of music data information and supplying said driving signals to the key actuators associated with the keys to be driven; and a silent system including a hammer stopper changed between a free position and a blocking position, said hammer stopper in said free position allowing said hammers to generate said tones through vibrations of associated strings, said hammer stopper in said blocking position causing said hammers to rebound thereon before striking said strings, and an electronic sound generator connected to said music data information generator for generating electronic sounds.

19. The keyboard musical instrument as set forth in claim 18, in which said silent system informs said information processor that said hammer stopper is presently in one of said free position and said blocking position, and said information processor calculates said first hammer velocity on the basis of yet another of said plural distances and said second hammer velocity on the basis of still another of said plural distances shorter than said yet another of said plural distances, said sensor reaching said yet another of said plural distances and said still another of said plural distances later than said one of said plural distances and said another of said plural distances, respectively.

* * * * *